United States Patent [19]

Nakashima

[11] Patent Number: 5,024,401

[45] Date of Patent: Jun. 18, 1991

[54] CONTROL APPARATUS FOR QUAD-LINE STUNT KITES

[76] Inventor: Hiroshi Nakashima, 1503 N. Hayden Island Dr., #20, Portland, Oreg. 97217

[21] Appl. No.: 535,338

[22] Filed: Jun. 8, 1990

[51] Int. Cl.[5] ..... B64C 31/06

[52] U.S. Cl. ..... 244/155 A; 244/155 R; 242/96

[58] Field of Search ..... 244/153 R, 155.12, 155 A; 242/96

[56] References Cited

U.S. PATENT DOCUMENTS

| | | | |
|---|---|---|---|
| 3,086,739 | 4/1963 | Barber | 244/155 A |
| 3,409,255 | 11/1968 | Sada . | |
| 4,172,567 | 10/1979 | Post . | |
| 4,653,702 | 3/1987 | McGinnis . | |
| 4,714,217 | 12/1987 | Prentice | 244/155 R |
| 4,821,976 | 4/1989 | Nakashima | 242/96 |
| 4,892,272 | 1/1990 | Hadzicki | 244/153 R |

OTHER PUBLICATIONS

"Into the Wind" 1989 Kite Catalog, p. 11.

*Primary Examiner*—Joseph F. Peters, Jr.
*Assistant Examiner*—Linda L. Palomar
*Attorney, Agent, or Firm*—Henderson & Sturm

[57] ABSTRACT

An apparatus for controlling quad-line stunt kites of a type having a pair of handles with lines connected to each end of each handle. This is essentially all the control that is used during the normal kite flying procedure, but when it is desired to bring the kite line in or to let the line out, pick-up and/or pay-out structures are used in conjunction with the control handles. Specifically this pick-up and pay-out structure includes a first rod which extends through a pair of openings in the top of each of the control handles respectively and has a crank portion on one end thereof. A second rod extends through a pair of aligned openings in the lower portion of each of the control handles respectively. An axle, which is adapted to be rotated about an axis, is attached to one end of the first and the second rod and a tubular member is adapted to slide over the axle so that a person can grasp the tubular member in one hand and the crank in the other hand to rotate both rods and both handles about the axis. A guide rod structure with four partial loops therein is attached to the tube and is adapted to receive one of the lines in each one of the respective partial loops so that during the aformentioned rotation of the handles and rods, the four lines will be wound evenly onto or off of the first and second rods.

5 Claims, 1 Drawing Sheet

CONTROL APPARATUS FOR QUAD-LINE STUNT KITES

TECHNICAL FIELD

The present invention relates generally to a control apparatus for quad-line stunt kites and more particularly to such a control with a quick pay-out and pick-up feature.

BACKGROUND ART

A typical control for a quad-line stunt kite is the use of two elongated handles, one held in each hand and movable independently and having a line attached to each end of each control handle leading to and connected to the kite. This type of control system is an extremely good one in the hands of an experienced quad-line stunt kite person. The problems with this type of system relate mainly to being unable to let out all or pay-out the quad lines together (4 lines) before flying, wind up or pick-up the lines after the kite is landed. Since this problem has not heretofore been solved, there existed a need for a good solution to it.

DISCLOSURE OF THE INVENTION

The present invention relates generally to an apparatus for controlling quad-line stunt kites of a type having a pair of handles with lines connected to each end of each handle. This is essentially all the control that is used during the normal kite flying procedure, pick-up and/or pay-out structures are used in conjunction with the control handles before flying the kite and after landing the kite.

Specifically this pick-up and pay-out structure includes a first rod which extends through a pair of openings in the top of each of the control handles respectively and has a crank portion on one end thereof. A second rod extends through a pair of aligned openings in the lower portion of each of the control handles respectively. An axle, which is adapted to be rotated about an axis, is attached to one end of the first and the second rod and a tubular member is adapted to slide over the axle so that a person can grasp the tubular member in one hand and the crank in the other hand to rotate both rods and both handles about the axis.

A guide rod structure with four partial loops therein is attached to the tube and is adapted to receive one of the lines in each one of the respective partial loops so that during the aforementioned rotation of the handles and rods, the four lines will be wound evenly onto or off of the first and second rods.

An object of the present invention is to provide an improved control apparatus for a quad-line stunt kite.

Another object of the present invention is to provide a control apparatus of the aforementioned type which allows the line to be easily and quickly picked-up or paid-out.

A still further object of the present invention is to provide an improved quad-line control apparatus which prevents tangling of the lines during the pick-up and pay-out procedure.

A still further object of the present invention is to provide an improved quad-line stunt kite control apparatus which can be removed from the control handles so that it does not interfere with the control of the kite during normal operation thereof but which can be quickly added to the control handles when it is decided to pick-up or pay-out the line.

Other objects, advantages, and novel features of the present invention will become apparent from the following detailed description of the invention when considered in conjunction with the accompanying drawings.

BEST MODE FOR CARRYING OUT THE INVENTION

Figures 1, 2, 3, 4:
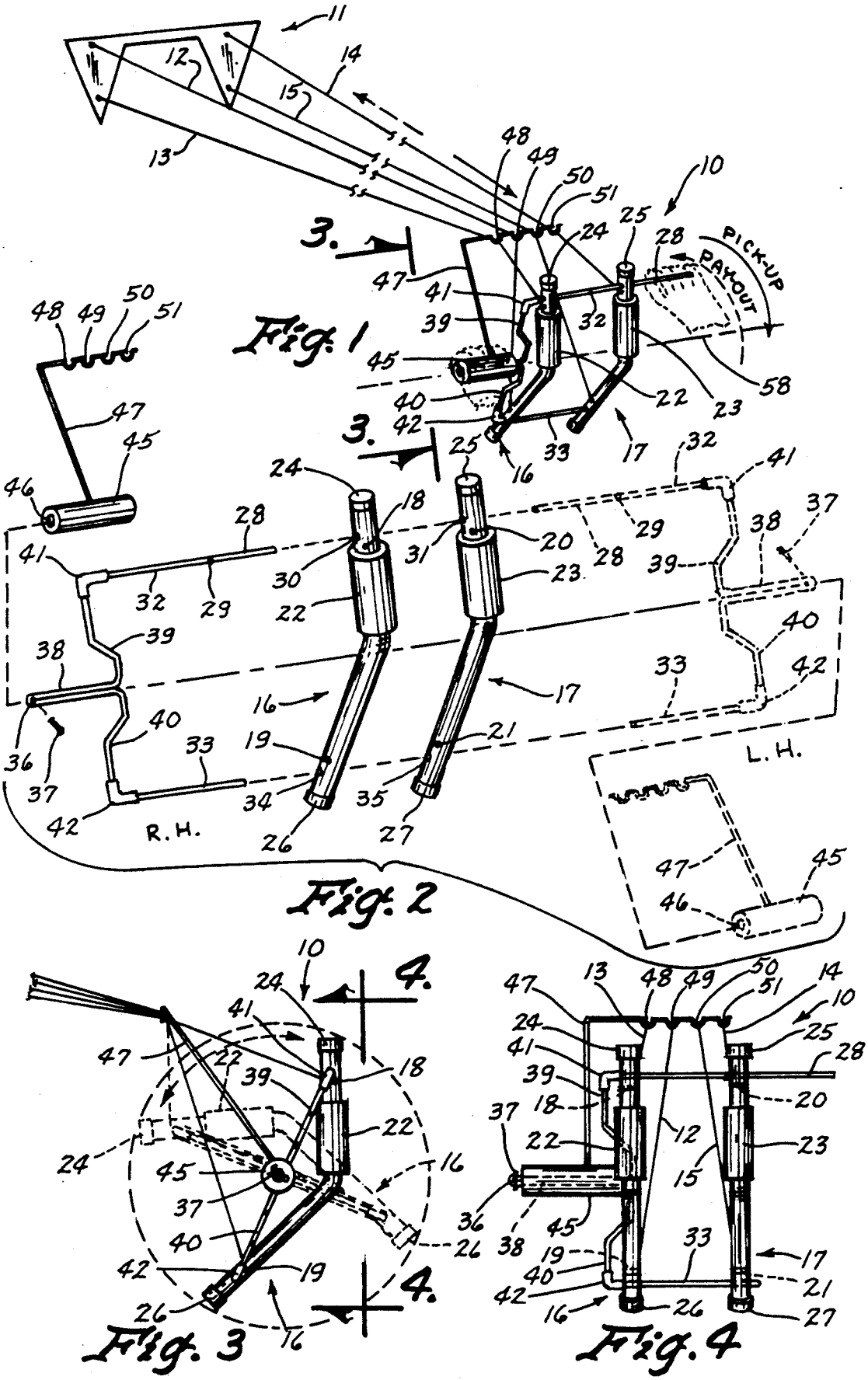
FIG. 1 is a perspective view of a preferred embodiment of the present invention shown in use for the pick-up or pay-out of the four lines of a quad-line stunt kite.
FIG. 2 is an exploded perspective view of the control apparatus of FIG. 1.
FIG. 3 is a side elevational view of the control apparatus shown in FIG. 1.
FIG. 4 is a view of the control apparatus from the perspective of someone using it, except that the person's hands are not shown attached to the handles thereof.

Referring now to the drawings wherein like reference numerals designate identical or corresponding parts throughout the several views, FIG. 1 shows a control apparatus (10) constructed in accordance with the present invention in use for controlling a quad-line kite (11). Four lines (12), (13), (14) and (15) are connected to the kite (11) and to handles (16) and (17) by tying them to the openings (18) and (19) of handle (16) and openings (20) and (21) of handle (17). These handles (16) and (17) have an intermediate bend therein and foam rubber hand gripping portions (22) and (23) respectively. Optional caps (24), (25), (26) and (27) are also provided for the ends of the handles (16) and (17).

Openings (30) and (31) are provided in the top of the handles (16) and (17) for reception of a first rod (32) and openings (34) and (35) in the bottom portion of handles (16) and (17) are provided for selective reception of a second rod (33).

An axle (38) can be formed in one piece with the rods (32) and (33) if desired and are interconnected by portions (39) and (40) to the rods (32) and (33). Enlarged joints (41) and (42) are provided partially as stops for the rods (32) and (33) when received through openings (30), (31), (34) and (35). Crank handle (28) is an extension of rod (32).

A tubular handle member (45) has an opening (46) therethrough. A rigid extension bar (47) is bent on the end thereof and has a series of partial loops (48), (49), (50) and (51) therein for receiving lines (12), (13), (14) and (15) therein as is shown in FIG. 1.

In operation, when it is desired to use the control apparatus (10), the kite (11) would normally be in the act of flying as is shown in FIG. 1, except that the handle (45) would be removed along with the string guide therefor and the rods (32) and (33) and rigidly connected thereto would be removed.

When the user decides to pick-up the string (12–15), then the rod (32) would be placed through aligned openings (30) and (31) and the rod (33) would be placed through aligned openings (34) and (35) as is shown in FIG. 1, for use by a right-handed person. Then the tubular member (45) would be slid onto the axle (48) and a cotter key (37) would be placed through an opening (36) to keep the handle (45) from slipping off of the axle (38). The string or line (12–15) would then be placed into the guide loops (48–51) as is shown in FIG.

1. The lines (12–15) can then be wound up by winding in the rotary direction shown in solid lines in FIG. 1 or, alternatively, the lines (12–15) can be let out or paid-out by rotating the apparatus in the direction shown by the arrow in dashed lines in FIG. 1, whereby the entire apparatus rotates around an axis (58). A mark or index (29) on the rod (32) allows the user to know the approximate spacing to be used between the handle (16) and (17) when on the rod (32).

If a left-handed person desires to use the apparatus (10), then the rods (32) and (33) and axle (38) are merely put in from the other side as is shown in dashed lines in FIG. 2 and, similarly, the tubular member (45) and the guide loops (48–51) are similarly reversed as is shown in dashed lines in FIG. 2.

Accordingly it will be appreciate that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. Apparatus to controlling quad-line stunt kites comprising:

a first handle member having a top portion, an intermediate portion and a bottom portion;

a second handle member having a top portion, an intermediate portion and a bottom portion;

means for attaching a first flexible line to the top portion of said first handle member;

means for attaching a second flexible line to the bottom portion of said first handle member;

means for attaching a third flexible line to the top portion of said second handle member;

means for attaching a fourth flexible line to the bottom portion of said second handle member;

first connecting means for selectively interconnecting the first portion of the first handle member with the first portion of the second handle member;

second connecting means for selectively interconnecting the second portion of the second handle member;

an axle having an axis of rotation;

means for attaching said axle to said first and second connecting means;

crank means attached to said first connecting means and adapted to be grasped with one hand;

means for permitting said axle to be grasped with a person's other hand whereby rotation of said first and second handle members and said first and second connecting means about said axis is accomplished by a cranking motion with said one hand and whereby such rotation causes said first, second, third and fourth lines to wind around said first and second connecting means wherein said axle grasping means comprises a tubular member rotatably disposed on said axle whereby said axle rotates inside of said tubular member; and, a guide means attached to said tubular member for guiding said first, second, third and fourth lines onto or off of said first and second connecting means as said crank means is rotated around said axis; including first, second, third and fourth partial loops in said guide means for receiving first, second, third and fourth lines respectively.

2. The apparatus of claim 1 wherein said axis, said first connecting means, said second connecting means and said crank are all generally parallel to each other.

3. The apparatus of claim 1 wherein said first connecting means includes a first pair of aligned holes in the upper portions of said first and second handle members respectively through which a first rod is disposed.

4. The apparatus of claim 3 wherein said second connecting means includes a second pair of aligned holes in the bottom portion of said first and second handle members respectively through which a second rod is disposed.

5. The apparatus of claim 4 wherein said crank is an extension of said first rod.

* * * * *